US012268916B2

(12) United States Patent
Rudan et al.

(10) Patent No.: US 12,268,916 B2
(45) Date of Patent: Apr. 8, 2025

(54) DUMBBELL

(71) Applicants: Michael Rudan, Toronto (CA); Lee Kline, Toronto (CA)

(72) Inventors: Michael Rudan, Toronto (CA); Lee Kline, Toronto (CA)

( * ) Notice: Subject to any disclaimer, the term of this patent is extended or adjusted under 35 U.S.C. 154(b) by 0 days.

(21) Appl. No.: 17/162,092

(22) Filed: Jan. 29, 2021

(65) Prior Publication Data

US 2021/0236873 A1 Aug. 5, 2021

Related U.S. Application Data

(60) Provisional application No. 62/968,012, filed on Jan. 30, 2020.

(51) Int. Cl.

| | |
|---|---|
| ***A63B 21/072*** | (2006.01) |
| ***A63B 21/00*** | (2006.01) |
| ***A63B 21/06*** | (2006.01) |
| ***A63B 71/00*** | (2006.01) |

(52) U.S. Cl.

CPC ..... *A63B 21/0726* (2013.01); *A63B 21/0601* (2013.01); *A63B 21/4035* (2015.10); *A63B 71/0036* (2013.01); *A63B 2209/00* (2013.01)

(58) Field of Classification Search

CPC ..... A63B 21/0726; A63B 21/0601; A63B 21/4035; A63B 71/0036; A63B 2209/00; A63B 21/0004; A63B 21/06; A63B 21/0604; A63B 21/0607; A63B 21/072–075; A63B 21/4023; A63B 21/4033

See application file for complete search history.

(56) References Cited

U.S. PATENT DOCUMENTS

| | | | | |
|---|---|---|---|---|
| 4,768,780 A * | 9/1988 | Hayes | A63B 21/0724 482/106 |
| 4,964,631 A * | 10/1990 | Marano | A63B 21/4013 482/93 |
| 6,485,399 B2 * | 11/2002 | Greene | A63B 21/4015 482/106 |
| 8,574,136 B1 * | 11/2013 | Burstrom | A63B 21/0724 482/109 |
| 10,864,402 B2 | 12/2020 | Laurence | |

(Continued)

FOREIGN PATENT DOCUMENTS

WO WO-2018014132 A1 * 1/2018 ..... A41D 13/0015

OTHER PUBLICATIONS

Dymo Amazon listing (derived from: DYMO store, "DYMO 3D Plastic Embossing Labels for Embossing Label Makers" [online], Date First Available: May 23, 2015 [retrieved on Jul. 13, 2024], Retrieved from: https://www.amazon.com/DYMO-Plastic-Embossing-Labels-1933353/dp/B00Y4S5QXU) (Year: 2015).*

(Continued)

*Primary Examiner* — Joshua Lee
*Assistant Examiner* — Catrina A Letterman
(74) *Attorney, Agent, or Firm* — James A. Sheridan; Sheridan Law, LLC

(57) ABSTRACT

An improved dumbbell free weight is discussed, which includes one or more base weights, the dumbbell further having a pair of second, upper weights positioned above where the upper weights are suspended by upper braces extending from a handle attached to the one or more base weights.

7 Claims, 7 Drawing Sheets

(56) References Cited

U.S. PATENT DOCUMENTS

| | | | | |
|---|---|---|---|---|
| 2014/0024506 | A1* | 1/2014 | Vixathep | A63B 21/072 482/108 |
| 2014/0066269 | A1* | 3/2014 | Wheler | A63B 21/075 482/110 |
| 2015/0258412 | A1* | 9/2015 | Doerr | A63B 21/00065 482/92 |
| 2015/0321044 | A1* | 11/2015 | English | A63B 21/072 248/415 |
| 2016/0175640 | A1* | 6/2016 | Kempton | A63B 21/0726 482/106 |
| 2017/0144011 | A1* | 5/2017 | Gangemi | A63B 21/0552 |
| 2018/0296870 | A1* | 10/2018 | Gangemi | A63B 21/0728 |
| 2018/0296873 | A1* | 10/2018 | Amyan | A63B 21/0722 |
| 2019/0022451 | A1* | 1/2019 | Koenig | A63B 21/072 |
| 2019/0275403 | A1 | 9/2019 | Rudan | |

OTHER PUBLICATIONS

Examiner's Search Report issued for CA 3,107,358; Mar. 28, 2022, 5 pp.

* cited by examiner

DUMBBELL

CROSS-REFERENCE TO RELATED APPLICATIONS

This application claims priority of U.S. provisional patent application Ser. No. 62/968,012 filed Jan. 30, 2020, which is incorporated by reference into this application in its entirety.

TECHNICAL FIELD

The present disclosure is related to the field of fitness equipment, in particular, free weights in the form of improved dumbbell weights that can be used in training in sports such as boxing.

BACKGROUND

Kettle bells are known forms of free weights, typically, in the form of a weight formed of metal, such as steel or iron, with a single loop-style handle attached to the weight. One problem with using kettle bells is that by virtue of their shape is that it can be difficult to hold the weight in a fixed position in a person's hand when the weight is lifted up an angle, such as in a side or front lateral raise exercise, where the weight handle will twist in the person's hand as the weight will rotate towards the ground due to gravity.

It is, therefore, desirable to provide an improved dumbbell weight that overcomes this problem.

SUMMARY

An improved dumbbell is provided. In some embodiments, the improved dumbbell can comprise a base weight with lower braces extending substantially upwards therefrom with a substantially horizontal handle extending between upper ends of the lower braces, wherein the improved dumbbell comprises a pair of upper weights supported by two sets of upper braces extending substantially upwards from the upper ends of the lower braces, thereby forming a "dumbbell-like" structure except that the handle is substantially orthogonal to an axis extending between the upper weight and the lower weight.

In some embodiments, the improved dumbbell can comprise a handle with a plurality of braces extending from one end of the handle, wherein each brace comprises a weight extending therefrom. In some embodiments, each weight can comprise a curved or arc configuration to provide a space for a person place their hand between the weights and grasp the handle.

Broadly stated, in some embodiments, an improved dumbbell can be provided, comprising: a handle; a plurality of braces extending from one end of the handle; and a weight extending from each of the plurality of braces.

Broadly stated, in some embodiments, each of the weights can comprise a curved or arc configuration.

Broadly stated, in some embodiments, the handle can comprise a grip disposed at least partially thereon or therearound.

Broadly stated, in some embodiments, the grip can comprise an elastomeric material.

Broadly stated, in some embodiments, the handle can comprise an opening disposed on one thereof.

Broadly stated, in some embodiments, the improved dumbbell can further comprise a weight stand having at least one peg extending therefrom, wherein the at least one peg is configured to fit within the opening so as to place or store the improved dumbbell on the at least one peg.

Broadly stated, in some embodiments, an improved dumbbell can be provided, comprising: a first weight; at least one first brace extending substantially from the first weight; a substantially horizontal handle extending from a first end of the at least one first brace; a plurality of sets of at least one second brace extending from the first end of the handle; and a second weight disposed on furthermost ends of each of the at least one second brace.

Broadly stated, in some embodiments, the first weight can comprise a substantially flat bottom surface thereby the dumbbell is configured to stand unsupported without tipping over.

Broadly stated, in some embodiments, the at least one first brace can be substantially vertical extending upwardly from the first weight.

Broadly stated, in some embodiments, the at least one second brace can be rotated by an angle phi relative to the lower braces.

Broadly stated, in some embodiments, the angle phi can range from 90° to 160°.

Broadly stated, in some embodiment, an improved dumbbell can be provided, comprising: a pair of base weights; two sets of lower braces, wherein each of the pair of base weights comprises one set of lower braces extending substantially upwards therefrom; a substantially horizontal handle extending between upper ends of the lower braces; two sets of upper braces extending upwards from the upper ends of the lower braces; and an upper weight disposed on uppermost ends of each of the two sets of upper braces.

Broadly stated, in some embodiments, each of the pair of base weights can comprise a substantially flat bottom surface thereby the dumbbell is configured to stand unsupported without tipping over.

Broadly stated, in some embodiments, the two sets of lower braces can be separated by an angle alpha.

Broadly stated, in some embodiments, the angle alpha can range from 45° to 135°.

Broadly stated, in some embodiments, the upper braces can be rotated by an angle phi relative to the lower braces.

Broadly stated, in some embodiments, the angle phi can range from 45° to 135°.

Broadly stated, in some embodiments, the upper or second weights can comprise less weight or mass than that of the base or first weight or weights.

Broadly stated, in some embodiments, the weight or mass of the upper or second weights can range from 0.1 to 1.0 of that of the base or first weight or weights.

Broadly stated, in some embodiments, the handle can comprise a proprioceptive wrap disposed at least partially therearound.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment can also be included in other embodiments but is not necessarily included. Thus, the present technology can include a variety of combinations and/or integrations of the embodiments described herein.

Figure 1:
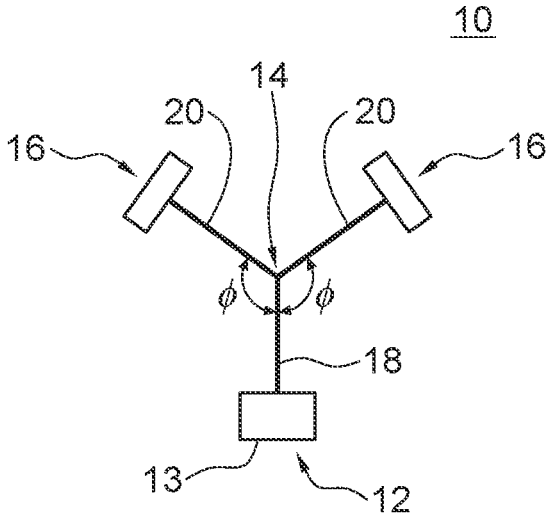
FIG. 1 is a block diagram depicting one embodiment of an improved dumbbell.
Figure 2:
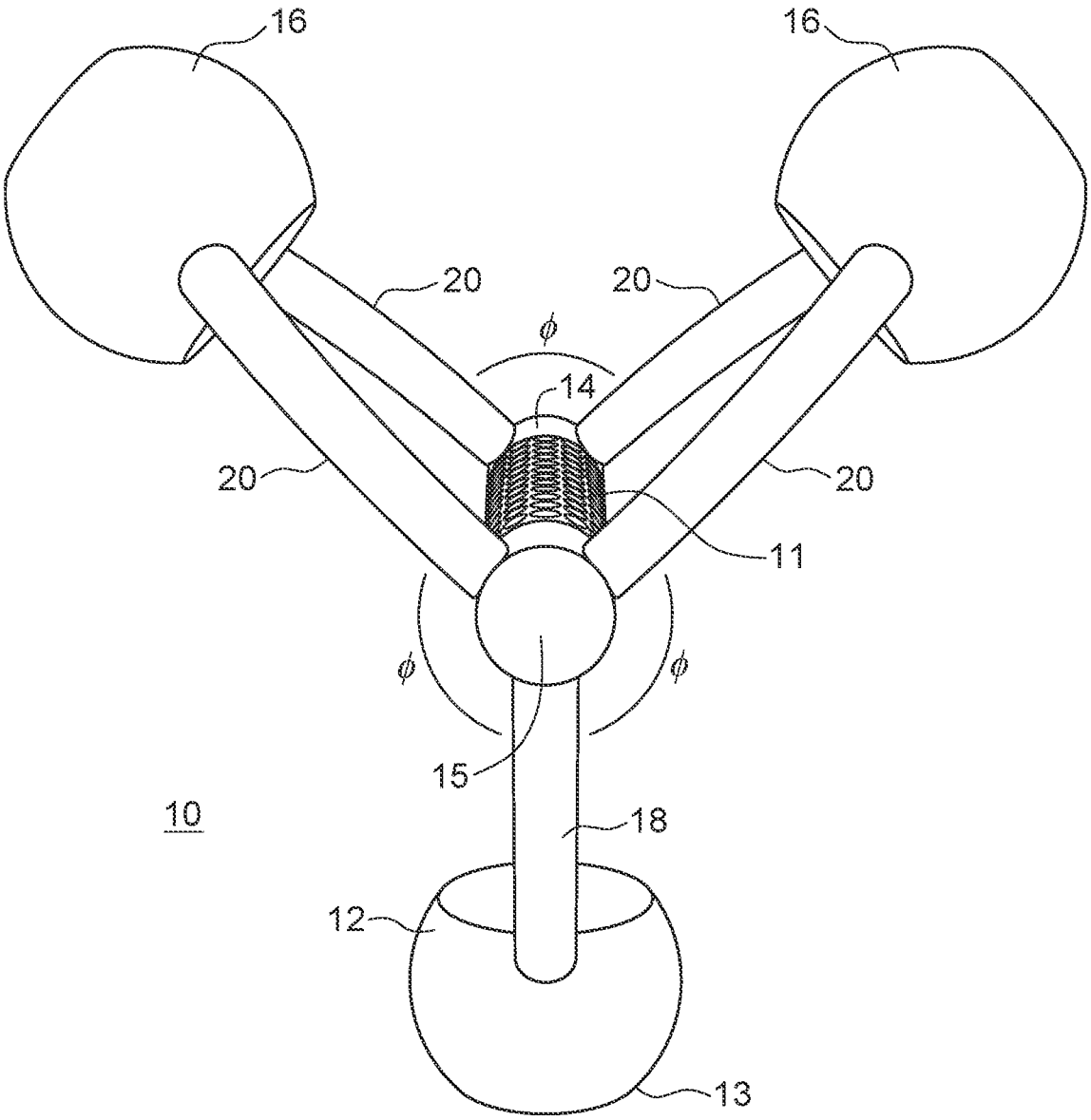
FIG. 2 is a photograph depicting a front elevation view of the improved dumbbell of FIG. 1.
Figure 3:
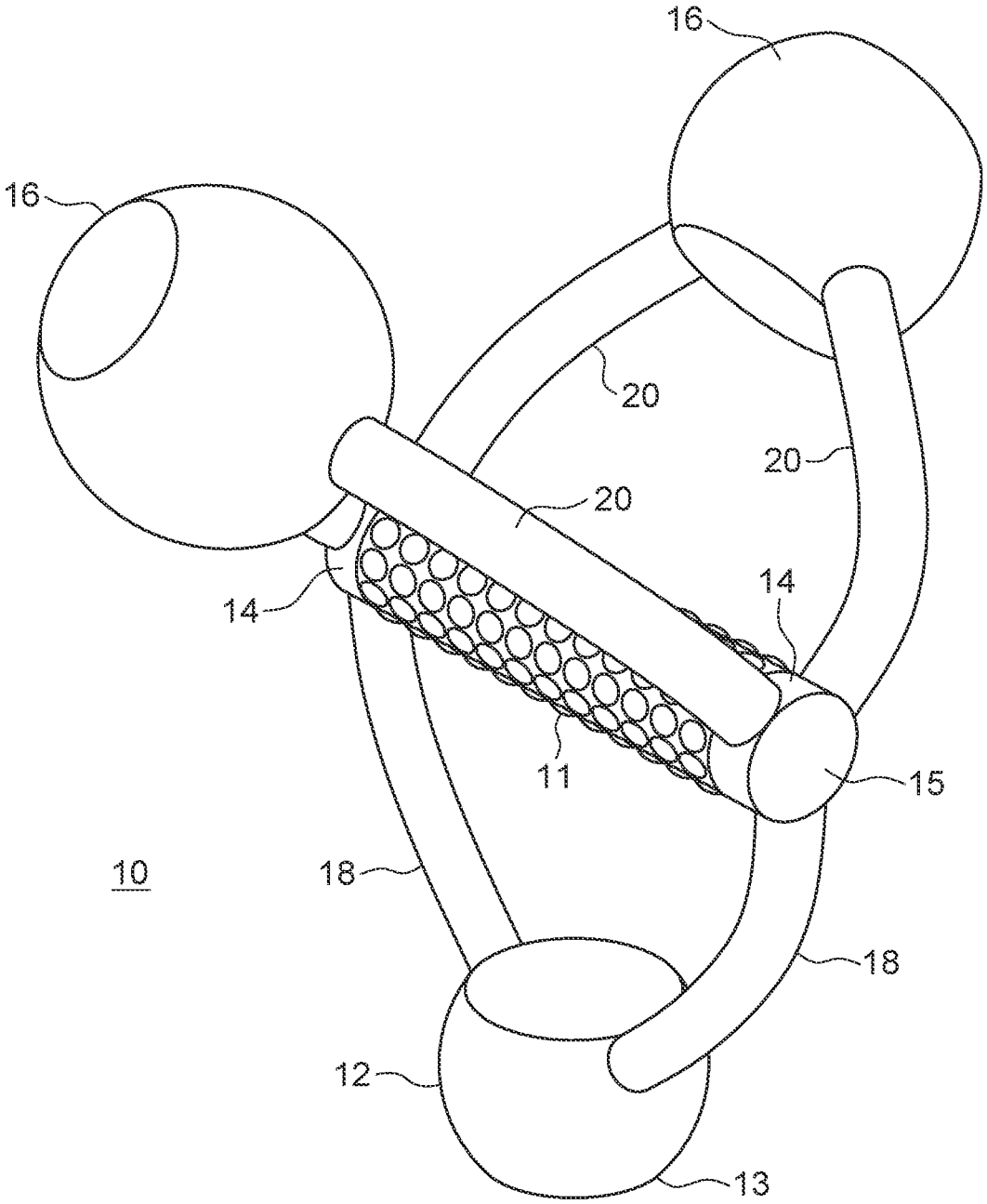
FIG. 3 is a photograph depicting a perspective view of the improved dumbbell of FIG. 1.

Referring to FIGS. 1 to 3, one embodiment of improved dumbbell 10 is illustrated. In some embodiments, improved dumbbell 10 can comprise of first or base weight 12 having bottom surface 13 that can be configured for resting on a flat horizontal surface such as the floor. Improved dumbbell 10 can further comprise a pair of second or upper weights 16 disposed above first or base weight 12, wherein each second or upper weight 16 is supported by the combination of a plurality of sets of at least one second or upper brace 20, handle 14 and at least one first or lower brace 18 operatively connecting second or upper weights 16 to first or base weight 12. In the illustrated embodiment, dumbbell 10 comprises two sets of the at least one second or upper brace 20.

In some embodiments, handle 14 can be substantially horizontal and disposed vertically between second or upper weights 16 and first or base weight 12. In some embodiments, first or lower braces 18 can extend from ends 15 of handle 14 to first or base weight 12, and a set of second or upper braces 20 can extend from ends 15 to each second or upper weight 16.

In some embodiments, as shown in FIG. 1, each second or upper brace 20 can be disposed at a first angle relative to first or lower brace 18 as depicted by angle "@" ("phi"). In some embodiments, angle phi can range from 90° to 160°. In the illustrated embodiment, angle phi is approximately 120°.

In some embodiments, each second or upper weight 16 can comprise less weight or mass than that of first or base weight 12. In some embodiments, each second or upper weight 16 can range from approximately 0.1 or 10% to approximately 1.0 or 100% of the weight or mass of first or base weight 12. In the illustrated embodiment of improved dumbbell as shown in FIGS. 2 and 3, first or base weight 12 is approximately 10 pounds in weight and each second or upper weight 16 is approximately 5 pounds in weight.

By configuring improved dumbbell 10 with angle phi as applied to braces 18 and 20, respectively, each second or upper weight 16 can be positioned substantially above first or base weight 12 such that improved dumbbell 10 is stable when bottom surface 13 is placed on a floor. In addition, the space between the two second or upper weights 16 can provide clearance for a person's hand to easily grasp handle 14 between upper weights 16. By configuring improved dumbbell 10 in this manner, traditional free weight conventional dumbbell exercises can be performed with little or no twisting of handle 14 in the person's hand. In addition, the placement of upper weight 16 above the hand, in combination of the placement of base weight 12 below the hand, can result in additional muscles being worked when performing traditional free weight exercises as the improved dumbbell is being lifted and moved during these exercises.

Figure 4:
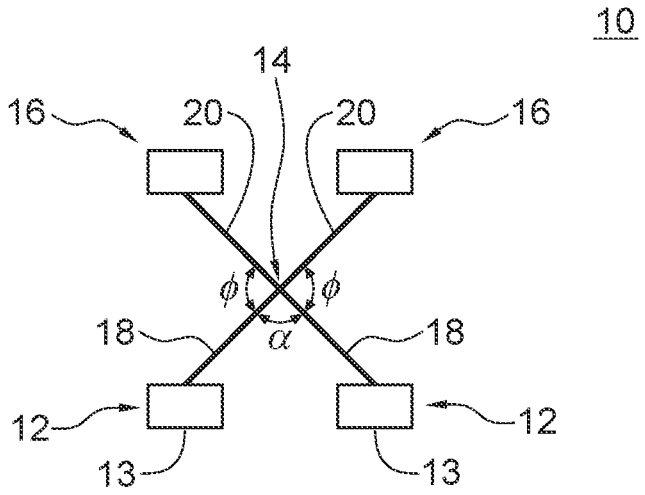
FIG. 4 is a block diagram depicting a second embodiment of an improved dumbbell.

Referring to FIG. 4, a second embodiment of improved dumbbell 10 is shown. In this embodiment, improved dumbbell 10 can comprise a pair of base weights 12 each having bottom surface 13 that can be configured for resting on a flat horizontal surface such as the floor. Improved dumbbell 10 can further comprise a pair of upper weights 16 disposed above base weight 12, wherein each upper weight 16 is supported by the combination of upper braces 20, handle 14 and lower braces 18 operatively connecting upper weights 16 to base weight 12.

As with the embodiment shown in FIG. 1, handle 14 in the embodiment shown in FIG. 4 can be substantially horizontal and disposed vertically between upper weights 16 and base weights 12. In some embodiments, a set lower braces 18 can extend from ends 15 of handle 14 to each base weight 12, and a set of upper braces 20 can extend from ends 15 to each upper weight 16.

In some embodiments, as shown in FIG. 4, each upper brace 20 can be disposed at a first angle relative to the nearest lower brace 18 as depicted by angle "@" ("phi"). In some embodiments, angle phi can range from 45° to 135°. In the illustrated embodiment, angle phi is approximately 90°.

In some embodiments, as shown in FIG. 4, each set of lower braces 18 can be disposed at a second angle relative to the other set of lower braces 18 as depicted by angle "α" ("alpha"). In some embodiments, angle alpha can range from 45° to 135°. In the illustrated embodiments, angle alpha is approximately 45°.

In some embodiments, each of the embodiments of dumbbell 10 described herein can comprise wrap 11 disposed at least partially around handle 14 as shown in FIGS. 2 and 3, and as described in applicant's U.S. patent application Ser. No. 16/319,168 filed on Jan. 18, 2019, which is incorporated by reference into this application in its entirety. The wrap can comprise a compressible proprioceptive material as described in applicant's U.S. patent application Ser. No. 16/319,168. The wrap can provide a proprioceptive response to a person using improved dumbbell 10 in an exercise activity.

Figure 5A:
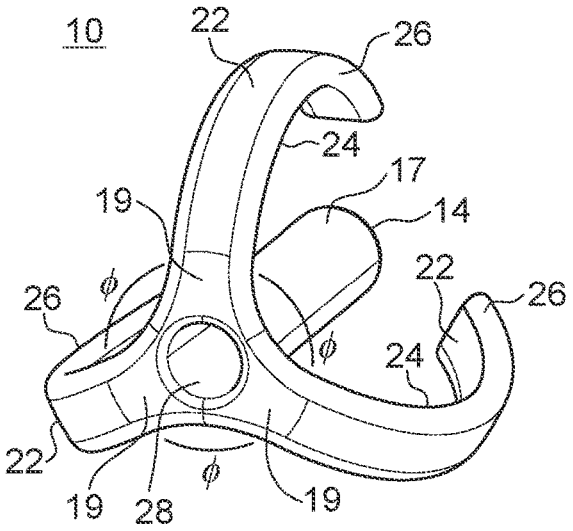
FIG. 5A is a front perspective view depicting a third embodiment of an improved dumbbell.
Figure 5B:
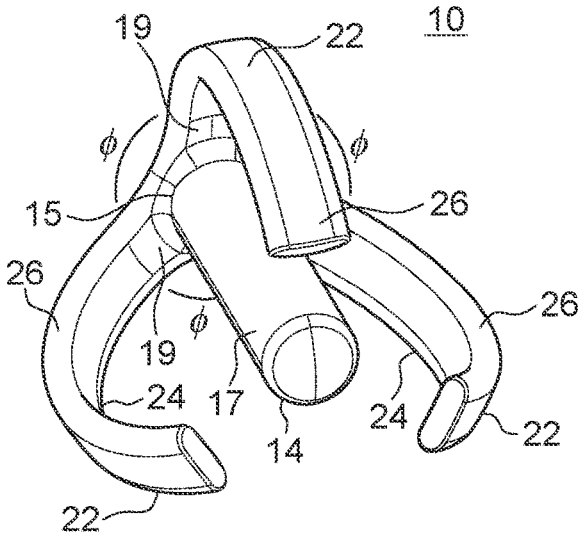
FIG. 5B is rear perspective view depicting the improved dumbbell of FIG. 5A.

Referring to FIGS. 5A and 5B, a third embodiment of improved dumbbell 10 is shown. In this embodiment, improved dumbbell 10 can comprise a plurality of weights 22 extending from braces 19 operatively coupled to end 15 of handle 14. In some embodiments, handle 14 can comprise grip 17 disposed at least partially thereon or therearound to provide improved grip to dumbbell 10 as well known to those skilled in the art. In some embodiments, grip 17 can be comprised of neoprene, rubber or other elastomeric material well known to those skilled in the art to provide enhanced grip to dumbbell 10. In other embodiments, grip 17 can comprise knurling on handle 14 to provide enhanced grip thereto. In some embodiments, handle 14 can further comprise wrap 11 (as shown in FIGS. 2 and 3) disposed at least partially therearound. In the illustrated embodiment, dumbbell 10 can comprise three weights 22 wherein each weight 22 is disposed substantially equidistant apart from an adjacent weight 22 wherein each weight 22 is disposed rotate by angle phi apart from its adjacent weights 22. In the illustrated embodiment, angle phi can be substantially 120°. In some embodiments, one or more weights 22 can be curved in configuration to form arc 24 as shown in FIGS. 5A and 5B. In some embodiments, arc 24 can provide additional space between weights 22 and handle 14 for a person to place their hand therearound while keeping the overall size of dumbbell 10 smaller than conventional dumbbells. In some embodiments, this embodiment of dumbbell can be comprised of metal, non-metal material with metal disposed therein or other suitable materials well known to those skilled in the art of making dumbbells. In some embodiments, the overall weight or mass of dumbbell 10 can be a function of the weight or mass of handle 14, braces 19 and of each weight 22, which can further be a function of its thickness 26. In the illustrated embodiment of FIGS. 5A and 5B, thickness 26 of weight 22 can be selected such that the overall weight of dumbbell can be approximately 3 pounds. In some embodiments, dumbbell 10 can comprise opening 28 disposed into an end of handle 14 to provide means for placing and storing dumbbell 10 on a weight tree or stand. In some embodiments, opening 28 can be disposed on the end of handle 14 adjacent to where braces 19 extend therefrom although in other embodiments, opening 28 can be disposed into the other end of handle 14.

Figure 6A:
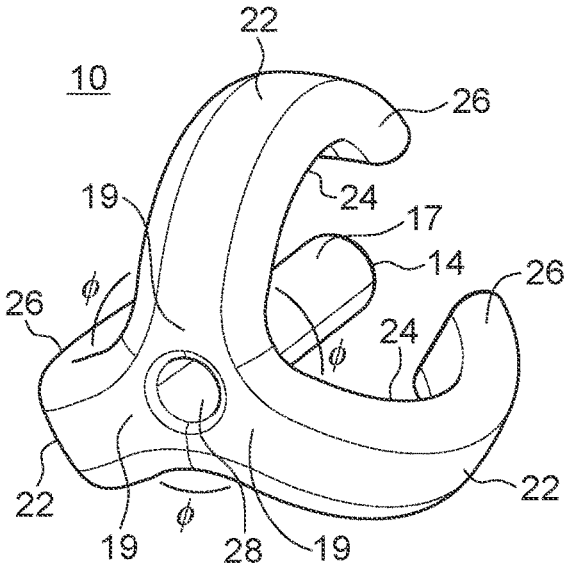
FIG. 6A is a front perspective view depicting a fourth embodiment of an improved dumbbell.
Figure 6B:
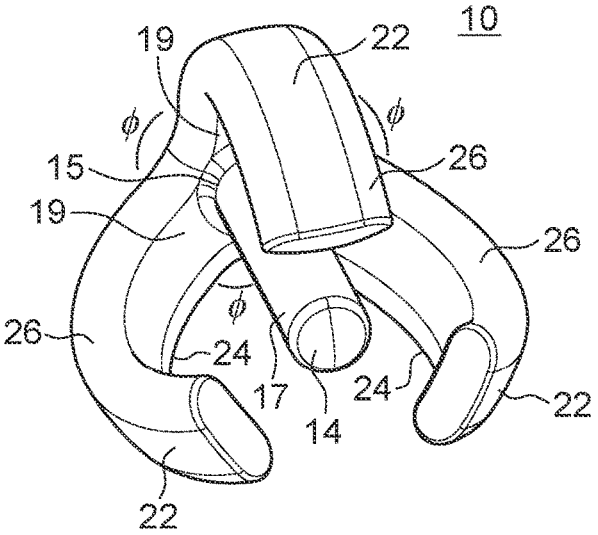
FIG. 6B is rear perspective view depicting the improved dumbbell of FIG. 6A.

Referring to FIGS. 6A and 6B, a fourth embodiment of improved dumbbell 10 is shown. In this embodiment, improved dumbbell 10 can comprise a plurality of weights 22 extending from braces 19 operatively coupled to end 15 of handle 14. In some embodiments, handle 14 can comprise grip 17 disposed at least partially thereon or therearound to provide improved grip to dumbbell 10 as well known to those skilled in the art. In some embodiments, grip 17 can be comprised of neoprene, rubber or other elastomeric material well known to those skilled in the art to provide enhanced grip to dumbbell 10. In other embodiments, grip 17 can comprise knurling on handle 14 to provide enhanced grip thereto. In some embodiments, handle 14 can further comprise wrap 11 (as shown in FIGS. 2 and 3) disposed at least partially therearound. In the illustrated embodiment, dumbbell 10 can comprise three weights 22 wherein each weight 22 is disposed substantially equidistant apart from an adjacent weight 22 wherein each weight 22 is disposed rotate by angle phi apart from its adjacent weights 22. In the illustrated embodiment, angle phi can be substantially 120°. In some embodiments, one or more weights 22 can be curved in configuration to form arc 24 as shown in FIGS. 6A and 6B. In some embodiments, arc 24 can provide additional space between weights 22 and handle 14 for a person to place their hand therearound while keeping the overall size of dumbbell 10 smaller than conventional dumbbells. In some embodiments, this embodiment of dumbbell can be comprised of metal, non-metal material with metal disposed therein or other suitable materials well known to those skilled in the art of making dumbbells. In some embodiments, the overall weight or mass of dumbbell 10 can be a function of the weight or mass of handle 14, braces 19 and of each weight 22, which can further be a function of its thickness 26. In the illustrated embodiment of FIGS. 6A and 6B, thickness 26 of weight 22 can be thicker than thickness 26 of dumbbell 10 of FIGS. 5A and 5B such that the overall weight of dumbbell 10 can be approximately 10 pounds. In some embodiments, dumbbell 10 can comprise opening 28 disposed into an end of handle 14 to provide means for placing and storing dumbbell 10 on a weight tree or stand. In some embodiments, opening 28 can be disposed on the end of handle 14 adjacent to where braces 19 extend therefrom although in other embodiments, opening 28 can be disposed into the other end of handle 14.

Figure 7:
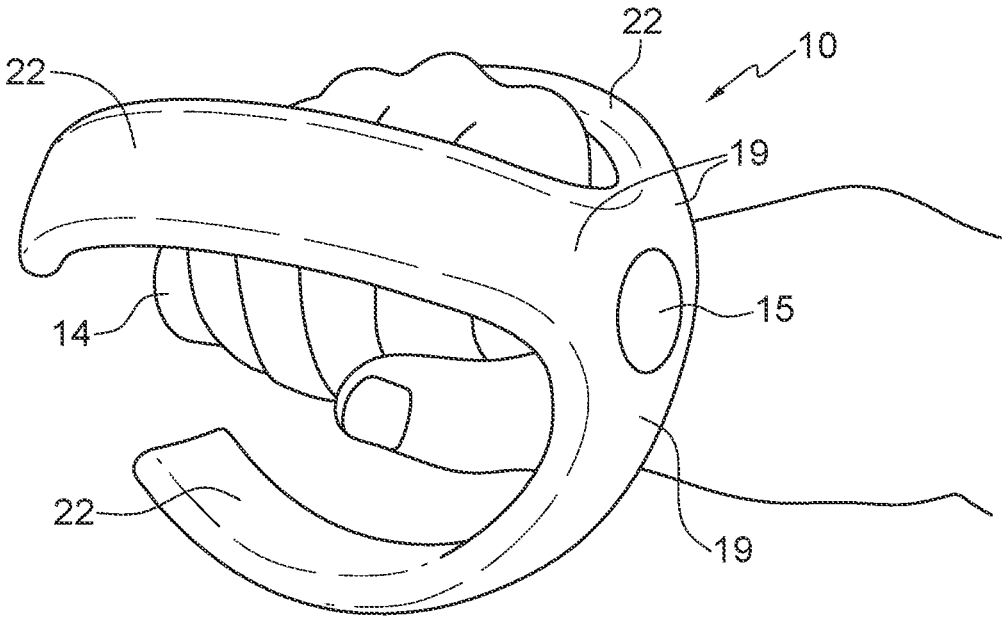
FIG. 7 is a perspective view depicting the improved dumbbell of FIG. 6A being held in an exercise position.

Referring to FIG. 7, the dumbbell of FIGS. 6A and 6B is shown in a position for exercise, wherein a person can grasp handle 14 by reaching through a pair of weights 22. When the person grasps two of dumbbells 10, one with each hand, the person can then engage in exercises by raising and lower their arms, extending and retracting their arms as well as moving their arms in a motion simulating boxing or other activity, all of which activity can result in strengthening the muscles and increasing the endurance of the person so exercising.

Figure 8:
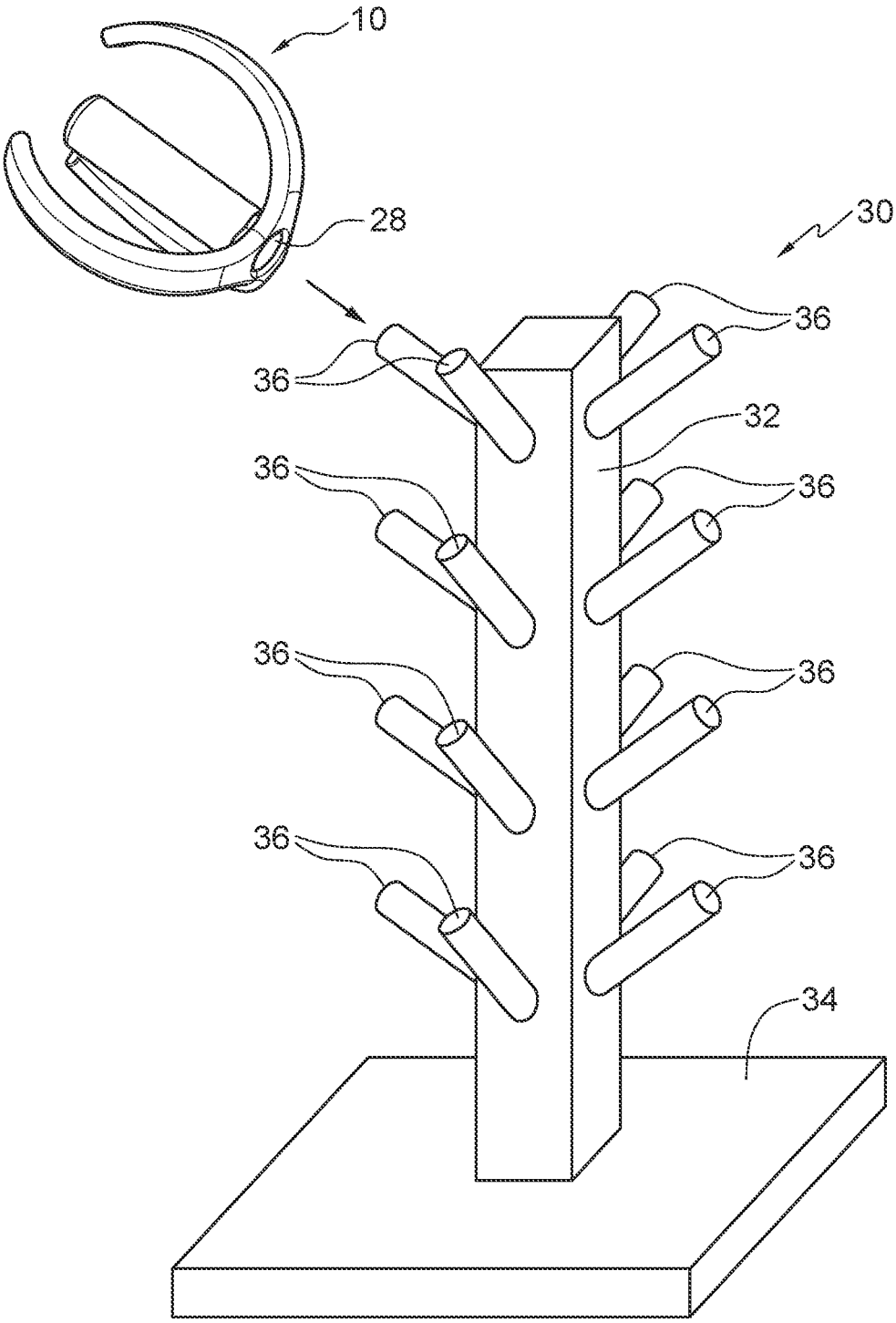
FIG. 8 is a perspective view depicting the improved dumbbell of FIG. 5A or 6A being mounted on a weight stand.

Referring to FIG. 8, one embodiment of weight stand 30 for use with dumbbell 10 is shown. In some embodiments, stand 30 can comprise of vertical post 32 extending upwards from base 34, wherein post 32 can comprise a plurality of pegs 36 extending therefrom for placing or storing dumbbell 10 thereon. In some embodiments, each peg 36 can be configured to fit within opening 28 disposed in dumbbell 10 as shown in FIGS. 5A and 6A as a means to place or store dumbbell 10 on a peg 36 on stand 30 when dumbbell 10 is not in use.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. An improved dumbbell, comprising:

a) a handle extending along a longitudinal axis from one end thereof, wherein the handle comprises an opening disposed on the one end thereof;

b) a plurality of braces extending from the one end of the handle, wherein each of the plurality of braces follows a curved or arc path disposed along a length thereof relative to the longitudinal axis of the handle;

c) wherein each of the plurality of braces comprises a weight; and d) a weight stand having at least one peg extending therefrom, wherein the at least one peg is configured to fit within the opening so as to place or store the improved dumbbell on the at least one peg.

2. The improved dumbbell as set forth in claim 1, wherein the handle comprises a grip disposed at least partially thereon or therearound.

3. The improved dumbbell as set forth in claim 2, wherein the grip comprises an elastomeric material.

4. The improved dumbbell as set forth in claim 1, wherein the handle comprises a proprioceptive wrap disposed at least partially therearound.

5. An improved dumbbell, comprising:

a) a handle, wherein the handle comprises an opening disposed on one end thereof;

b) a plurality of braces extending from the one end of the handle, wherein each of the plurality of braces comprises a curved or arc configuration disposed along a length thereof, wherein each of the plurality of braces comprises a weight; and c) a weight stand having at least one peg extending therefrom, wherein the at least one peg is configured to fit within the opening so as to place or store the improved dumbbell on the at least one peg.

6. The improved dumbbell as set forth in claim 5, wherein the handle comprises a grip disposed at least partially thereon or therearound, and wherein the grip comprises an elastomeric material.

7. The improved dumbbell as set forth in claim 5, wherein the handle comprises a proprioceptive wrap disposed at least partially therearound.

* * * * *